US008550187B2

(12) United States Patent
Bauer

(10) Patent No.: US 8,550,187 B2
(45) Date of Patent: Oct. 8, 2013

(54) DRILLING APPARATUS AND METHOD FOR WORKING THE GROUND

(75) Inventor: Sebastian Bauer, Schrobenhausen (DE)

(73) Assignee: Bauer Maschinen GmbH, Schrobenhausen (DE)

( * ) Notice: Subject to any disclaimer, the term of this patent is extended or adjusted under 35 U.S.C. 154(b) by 401 days.

(21) Appl. No.: 12/857,823

(22) Filed: Aug. 17, 2010

(65) Prior Publication Data

US 2011/0048805 A1 Mar. 3, 2011

(30) Foreign Application Priority Data

Aug. 28, 2009 (EP) ..... 09011061

(51) Int. Cl.
*E21B 21/02* (2006.01)

(52) U.S. Cl.
USPC ..... 175/215; 175/207; 175/315

(58) Field of Classification Search
USPC ..... 175/57, 121, 207, 215, 324
See application file for complete search history.

(56) References Cited

U.S. PATENT DOCUMENTS

| | | | | |
|---|---|---|---|---|
| 2,772,074 | A * | 11/1956 | Stoffa | 91/186 |
| 3,053,330 | A * | 9/1962 | Arthur | 173/197 |
| 3,212,578 | A * | 10/1965 | Hasha | 166/380 |
| 5,762,148 | A | 6/1998 | Kattentidt et al. | |
| 6,238,142 | B1 | 5/2001 | Harsch | |
| 7,198,434 | B2 * | 4/2007 | Blum | 405/241 |
| 7,306,405 | B2 | 12/2007 | Schmidmaier et al. | |
| 2004/0037652 | A1 | 2/2004 | Schmidmaier et al. | |

FOREIGN PATENT DOCUMENTS

| | | | |
|---|---|---|---|
| DE | 102 38 193 | A1 | 3/2004 |
| DE | 10 2007 018 788 | A1 | 10/2008 |
| EP | 0837190 | A2 | 4/1998 |
| EP | 1186718 | A1 | 3/2002 |
| EP | 1277887 | A2 | 1/2003 |
| GB | 2 377 235 | A | 1/2003 |
| JP | H08-074488 | A | 3/1996 |
| JP | H10-220157 | A | 8/1998 |
| JP | 3486678 | B2 * | 1/2004 |
| SU | 101740 | A | 12/1955 |

OTHER PUBLICATIONS

JPO-AIPN Machine Translation, "JP 3486678 B2 (Hamano et al)", Translated: Sep. 9, 2012.*
European Search Report; EP 09011061; Oct. 9, 2009.
The Patent Search Report from the Eurasian Patent Office dated Nov. 9, 2010; Eurasian Application No. 201001141.

* cited by examiner

*Primary Examiner* — David Andrews
*Assistant Examiner* — Richard Alker
(74) *Attorney, Agent, or Firm* — Studebaker & Brackett PC

(57) ABSTRACT

The invention relates to a drilling apparatus for working the ground comprising a drill drive for driving a drill string in a rotating manner and a rotary feedthrough for passing a construction material from a construction material hose into the interior of the drill string, whereby the rotary feedthrough has a first line connection for the construction material hose and a second line connection, rotatable relative to the first line connection, for the drill string. In accordance with the invention provision is made for the rotary feedthrough to have a rotary device for actively rotating the second line connection relative to the first line connection. The invention also relates to a method for working the ground, which can be carried out, in particular, by means of a drilling apparatus according to the invention.

12 Claims, 3 Drawing Sheets

DRILLING APPARATUS AND METHOD FOR WORKING THE GROUND

TECHNICAL FIELD

The invention relates to a drilling apparatus for working the ground in accordance with the preamble of claim 1. A drilling apparatus of such type is designed with a drill drive for driving a drill string in a rotating manner and a rotary feedthrough for passing a construction material from a construction material hose into the interior of the drill string, whereby the rotary feedthrough has a first line connection for the construction material hose and a second line connection, rotatable relative to the first line connection, for the drill string.

The invention further relates to a method for working the ground in accordance with the preamble of claim 12. In such a method provision is made for a drill string to be set into rotary motion by means of a drill drive and that via a rotary feedthrough, which is connected at a first line connection to a construction material hose and at a second line connection, rotatable relative to the first line connection, to the drill string, liquid construction material is introduced at least temporarily from the construction material hose into the interior of the drill string.

BACKGROUND

A generic drilling apparatus is known for instance from DE 102 38 193 A1. DE 102 38 193 A1 describes an earth drilling apparatus with which an auger can be set into rotation and introduced axially into the ground. Furthermore, a supply is provided, with which concrete can be introduced into the interior of the auger in order to fill the produced drill-hole. To enable an introduction of the concrete into the axially movable auger the supply has a movable hose line which is connected on the one hand at a fixed transfer point to the drilling apparatus and on the other hand to the auger. As a result of this movable hose line it is possible to move the auger up and down relative to the drilling apparatus. The hose line, which is connected in a rotationally fixed manner to the carrier vehicle, is connected via a rotary feedthrough, a so-called flush head, to the auger. This rotary feedthrough serves the purpose of uncoupling the rotary motion of the auger with respect to the hose line.

However, since a rotary feedthrough does, in practice, not operate in a frictionless way, a torque transmission from the auger to the hose line connection occurs regularly during operation despite the rotary feedthrough. In this case, in order to prevent the hose line from becoming bent or even winding itself around the auger or drill drive during operation of the drill drive, the hose line connection can be secured in a rotationally fixed manner with respect to the transfer point by means of a torque support.

However, such a torque support can be relatively complicated from a constructional viewpoint, especially when the drill string towers way up above the carrier vehicle and the rotary feedthrough arranged at the upper end of the drill string is therefore located far above the carrier vehicle, since the relevant distance also has to be covered by the torque support.

SUMMARY

The object of the invention is to improve a generic drilling apparatus and a generic drilling method in such a manner that an especially reliable construction material supply, more particularly a concrete supply, into the interior of the drill string is rendered possible in an especially easy way.

The object is solved in accordance with the invention by a drilling apparatus having the features of claim 1 and by a method having the features of claim 12. Preferred embodiments of the drilling apparatus are stated in the dependent claims.

The drilling apparatus according to the invention is characterized in that the rotary feedthrough has a rotary device for actively rotating the second line connection relative to the first line connection.

A fundamental idea of the invention can be seen in the fact that on the rotary feedthrough a rotary device with drive means is provided that enables the two connections of the rotary feedthrough to be rotated actively with respect to each other. In particular, this active rotary device can be synchronized with the drill drive in such a way that even on rotation of the drill string the line connection for the construction material hose always points in the same direction, i.e. the rotary motion of the drill string can be compensated actively by means of the rotary device according to the invention. As a result, a bending of the hose or even its winding around the drill string or the drill drive can be prevented effectively, ensuring thereby a reliable supply of concrete. At the same time, a laborious torque support of the hose connection is no longer required, since the alignment of the hose line connection relative to the fixed transfer point takes place by means of the active rotary device.

The drilling apparatus in accordance with the invention is, preferably, an earth drilling apparatus, in particular a continuous flight auger drilling appliance with Kelly extension. The rotary feedthrough, which can also be referred to as a flush head, is suitably arranged on the upper side of the drill string and/or coaxially to the drill string. By way of the rotary feedthrough a fluid connection can be established between the interior of the non-rotating construction material hose and the interior of the rotating drill string. The construction material introduced from the construction material hose into the interior of the drill string can, in particular, be concrete. The drill drive serves for driving the drill string in a rotating manner about the drilling axis, in which case the rotary feedthrough is advantageously arranged on the drilling axis.

It is especially preferred that in order to compensate the rotation of the drill drive the rotary device is synchronized diametrically opposed to the drill drive. This can be understood in particular in that the rotary device rotates the two line connections relative to each other at the rotational speed of the drill drive but in the opposite direction of rotation so that the rotary motions of the drill drive and the rotary device offset each other and the line connection for the construction material hose is outwards at a standstill even on rotation of the drill string. Synchronization can be effected, in particular, by means of a control that controls the rotary device, especially a related drive motor, depending on data concerning the rotational speed of the drill string and/or the drill drive. In principle, however, a mechanical synchronization would be conceivable, too.

Basically, it would be possible, for example, to operate the active rotary device with mechanical energy that is taken from the drill drive and transmitted e.g. by means of a flexible shaft onto the rotary device. However, it is especially advantageous for the rotary device to have at least one drive motor for actively rotating the second line connection relative to the first line connection. For a particularly compact arrangement the drive motor is suitably arranged on the rotary feedthrough, i.e. as a rule on the upper side of the drill string.

The drive motor concerned can be a hydraulic motor for example because on a typical drilling apparatus hydraulic energy is usually available at any rate. The drive motor can, however, also be an electric motor for example, as this can be controlled and therefore synchronized in a particularly easy way. In particular, a servo motor can be provided as drive motor of the rotary device. Basically, different motor types can also be combined in series for example.

Advantageously, according to the invention a control for the rotary device is provided, in particular an electronic control. By means of such a control e.g. the diametrically opposed synchronization can be realized in an especially simple manner. If provision is made for a drive motor, the control suitably is in operative connection with this drive motor, making it possible for the control to set e.g. a nominal rotational speed or a target position for the drive motor.

In addition, it is preferred that a rotation pick-up for determining the rotational speed and/or the direction of rotation of the drill string and/or the drill drive is provided, which is in signal connection with the control. In this way, the control receives input data concerning the status of the drill string so that it is able to operate the rotary device in the respective diametrically opposed manner. The control for the rotary device can also obtain information concerning the status of the drill string but also from other sources, as for instance from the control of the drill drive.

The invention can be employed in an especially advantageous manner in those drilling apparatuses, in which the drill string is designed, in particular, in several parts comprising a tool section that runs below the drill drive and an extension that runs at least in sections above the drill drive. For in such an embodiment with extended drill string a torque support for the hose connection, which is required in accordance with the prior art, would have to be extended correspondingly far up above, thus entailing a corresponding amount of additional work and effort. However, since such a torque support can be dispensed with in accordance with the invention, here this additional work and effort can be omitted, too.

Advantageously, the rotary feedthrough is arranged on the extension, in particular on the upper side of the extension. On the tool section provision can be made for example for the drilling tool, in particular an auger, by preference a so-called continuous flight auger.

Especially if an extension is provided the drill string can be supported in an axially movable manner relative to the drill drive in order to increase the drilling depth. Advantageously, in the area of the extension the drill string is supported in the drill drive. For active axial movement of the drill string an appropriate driving device can be present, too.

It is particularly advantageous that the drill drive is arranged on a supporting structure and that on the supporting structure a transfer connection for the construction material hose is arranged preferably in a rotationally fixed manner. Hence, according to this embodiment the drill drive and the transfer connection for the construction material hose are arranged on the same structure, whereby compensation of the rotary motion of the drill drive on the hose is rendered possible in an especially simple way. The supporting structure concerned can be a mast carriage for example. Such a mast carriage is advantageously supported in a longitudinally adjustable manner on a mast. In some cases the mast can also be regarded as the said supporting structure. The transfer connection can be understood in particular as a take-over point, at which the construction material can be introduced into the construction material line, i.e. at which the construction material hose can be connected to a feed device for the construction material, in particular to an associated feed line.

Another advantageous embodiment of the invention resides in the fact that on the line connection of the construction material hose the rotary feedthrough has an elbow. As a result, it can be ensured that when the rotary feedthrough is mounted the hose line connection faces towards the ground or at least towards the side allowing for the construction material hose to hang down freely from the line connection without forming any bends. In particular, it is of advantage that the line connection for the construction material hose is arranged axially parallel to the line connection for the drill string, whereby a rotary feedthrough is obtained that can be employed in an especially reliable way. For this purpose the elbow preferably has an arc angle of at least approximately 180°.

Furthermore, it is especially advantageous for the construction material hose to hang down freely from the line connection for the construction material hose and/or from the transfer connection. In particular, provision can be made for the construction material hose merely to be fixed at the hose ends and not retained and/or supported in the area between the two ends, i.e. it hangs freely. Due to the fact that according to the invention the active rotary feedthrough can ensure that the hose line connection of the rotary feedthrough is always located in the same angular position with respect to the transfer connection, a support, more particularly a torque support, of the hose between the hose ends can be dispensed with.

In addition, it is useful for the drive motor to be preferably arranged above the line connection for the drill string on the rotary feedthrough. As a result, a particularly compact arrangement is attained. For instance, provision can be made for the drive shaft of the drive motor to run at least approximately parallel to the drill string and to the drilling axis.

Another preferred embodiment of the invention resides in the fact that onto the first line connection, i.e. the connection for the hose, or onto the second line connection, i.e. the connection for the drill string, a further rotary feedthrough is connected. By means of such a second rotary feedthrough it can be ensured that the construction material hose is not overloaded even if, for example in the case of malfunction, the active synchronization of the first, active rotary feedthrough cannot be implemented to a sufficiently precise degree. Hence, should the rotation of the drill string, either intentionally or unintentionally, only be compensated partially by the first rotary feedthrough then the remaining difference in the rotation between the rotating drill string and the non-rotating hose line connection can be taken over by the second rotary feedthrough. By preference, the further rotary feedthrough is designed in a passive manner so that in contrast to the first rotary feedthrough it does not contain an active rotary device. In particular, the two rotary feedthroughs can be arranged coaxially. By way of alternative or in addition to a further rotary feedthrough the first, active rotary feedthrough can have a slip coupling between the two line connections for protection of the construction material hose.

The method in accordance with the invention can be carried out, in particular, by means of a drilling apparatus according to the invention. It is characterized in that a rotary device for actively rotating the second line connection relative to the first line connection is provided, whereby the rotary device is operated in diametrically opposed synchronization with the drill drive. As a result, the rotation of the drill string is compensated on the hose line connection.

BRIEF DESCRIPTION OF DRAWINGS

In the following the invention will be described in greater detail by way of preferred embodiments illustrated schematically in the accompanying Figures, wherein.

DETAILED DESCRIPTION

Figure 1:
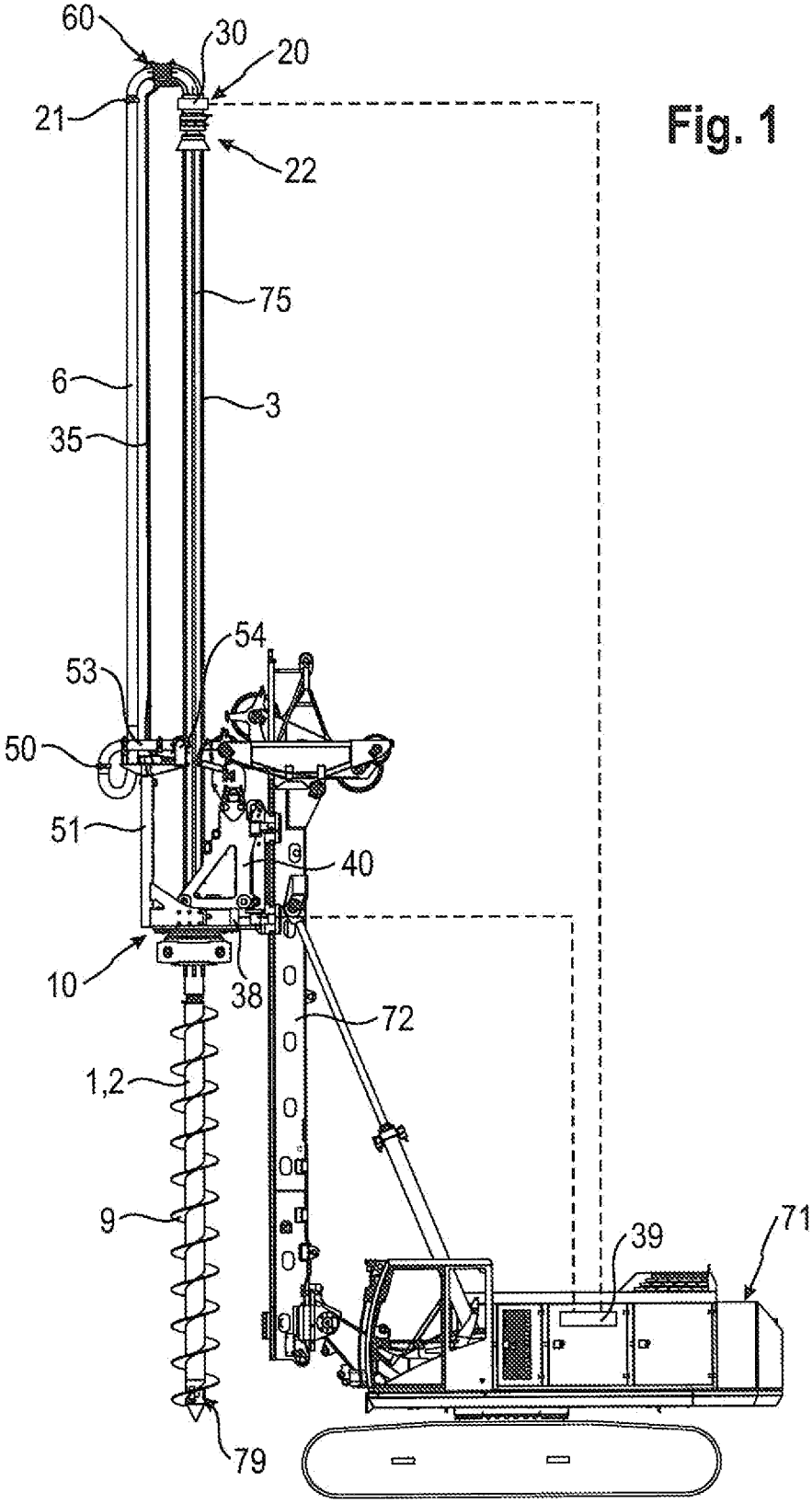
FIG. 1 shows a side view of a drilling apparatus in accordance with the invention.
Figure 2:
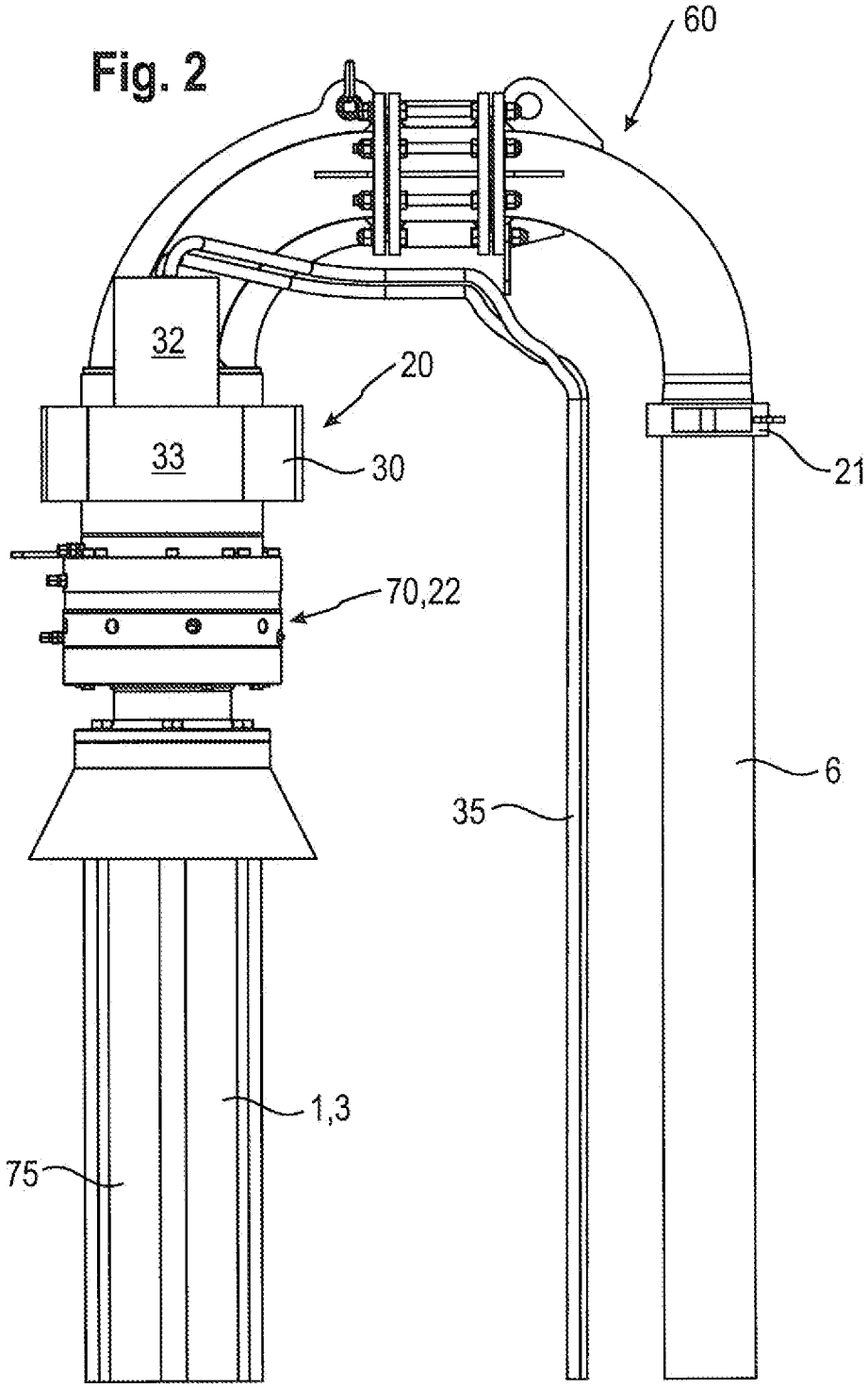
FIG. 2 shows a detailed view of the drilling apparatus of FIG. 1 in the area of the rotary feedthrough from the other side.
Figure 3:
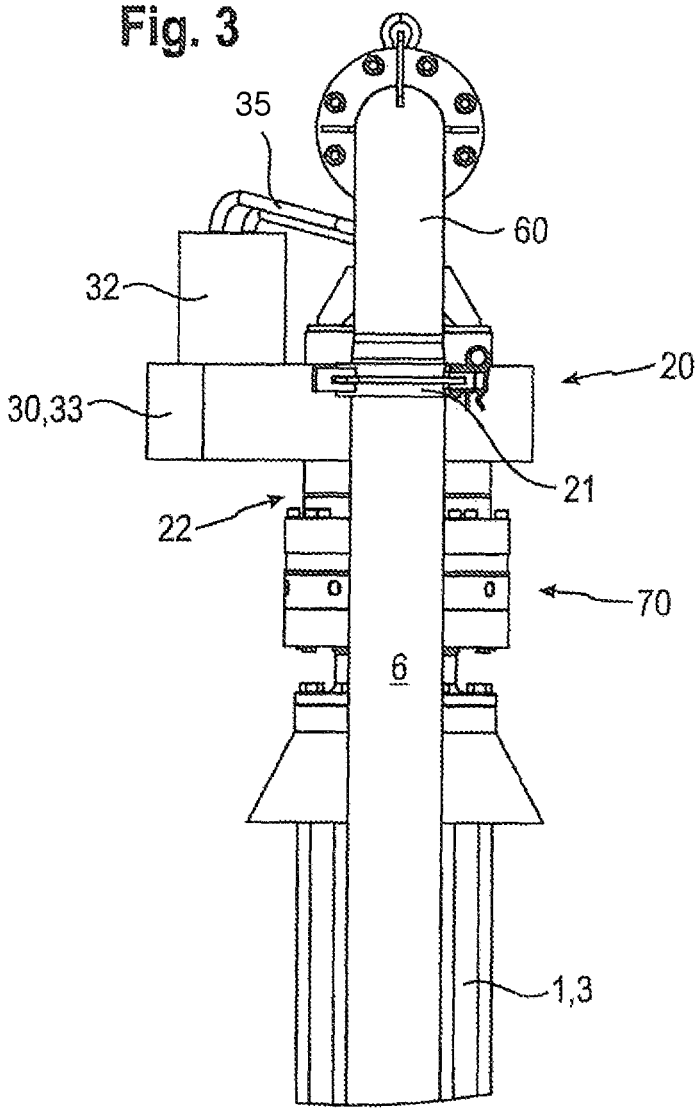
FIG. 3 shows a detailed view of the drilling apparatus of FIG. 1 in the area of the rotary feedthrough from the front.

FIGS. 1 to 3 show embodiments of a drilling apparatus in accordance with the invention.

As shown in FIG. 1, the drilling apparatus designed as an earth auger has a chassis 71 designed as a crawler track running gear. At the front of the chassis 71 a mast 72 is arranged, which, at least during drilling operation, normally runs at least approximately in a perpendicular fashion. On the mast 72 a mast carriage 40 is supported in a longitudinally displaceable manner. On this mast carriage 40, in turn, a drill drive 10 is provided for driving a drill string 1 in a rotating manner.

The drill string 1 has a tool section 2 which runs below the drill drive 10 and on which an auger 9 is arranged as a tool. Above the tool section 2 the drill string has an extension 3. In the area of this extension 3 the drill string 1 is guided through the drill drive 10. The extension 3 is designed as a so-called Kelly extension with externally located profile strips 75 that run longitudinally of the drill string 1. These profile strips 75 enable a formlocking torque transmission from the drill drive 10 to the extension 3 of the drill string 1, in which case the drill string 1 can at the same time be moved longitudinally relative to the drill drive 10.

Furthermore, the drilling apparatus has a construction material hose 6, by means of which a construction material, in particular a hardening construction material such as concrete, can be introduced into the interior of the drill string 1. From the interior of the drill string the construction material can escape through at least one opening 79 arranged at the bottom of the drill string 1. This arrangement allows for a drill-hole produced with the drill string 1 in the ground to be filled with construction material.

At its one end the construction material hose 6 is connected to a transfer connection 50. At this point the construction material can be transferred for example from a conveying device into the construction material hose 6. The transfer connection 50 is arranged in a rotationally fixed as well as axially fixed manner on the mast carriage 40. At its opposite lying upper end the construction material hose 6 is connected to a line connection 21 arranged at the upper end of the drill string 1. At this point the construction material can be introduced from the construction material hose 6 into the interior of the drill string.

The transfer connection 50 is designed at the end of an approximately horizontally running feed pipe piece 53 that is retained via an at least approximately perpendicularly running prop 51 on the mast carriage 40. Through the prop 51 the pipe piece 53 and its transfer connection 50 are joined in a rotationally fixed as well as axially fixed manner to the mast carriage 40. The pipe piece 53 and its transfer connection 50 are located above the mast carriage 40 and above the rotary drive 10. At its end facing away from the transfer connection 50 the pipe piece 53 has a further connection 54, to which e.g. a feed hose or an inflexible feed line can be connected that is joined to a construction material pump.

The transfer connection 50 for the construction material hose 6, the line connection 21 for the hose 6 as well as the further connection 54 face downwards, i.e. in the direction of the drilling axis towards the ground so that hoses can be connected there without the formation of bends.

The flexible design of line 6 as a construction material hose allows for the compensation of changes of distance between the line connection 21 and the transfer connection 50 that occur during displacement of the drill string 1 relative to the drill drive 10 and therefore to the mast carriage 40.

The construction material hose 6 is joined to the drill string 1 via a rotary feedthrough 20 according to the invention, which is shown in detail in FIGS. 2 and 3. The rotary feedthrough 20 is arranged at the upper end of the drill string 1 and has an axis of rotation that runs coaxially to the drilling axis, i.e. coaxially to the drill string 1.

As depicted in FIGS. 2 and 3 in particular, the rotary feedthrough 20 according to the invention is designed as an active rotary feedthrough with an active rotary device 30, in which case the rotary device 30 has a drive motor 32 and a gear transmission 33 that can be actuated by the drive motor 32. By means of the drive motor 32 and the associated gear transmission 33 the first line connection 21, on which the construction material hose 6 is arranged in a rotationally fixed manner, can be rotated actively about the drilling axis with respect to the second line connection 22, at which the rotary feedthrough 20 is connected to the drill string 1 in a rotationally fixed manner in particular.

For an especially compact arrangement the drive motor 32 is arranged above the line connection 22 for the drill string 1 as well as above the gear transmission 33. The drive motor 32 has operating and control lines 35 connected that lead to the chassis 71.

In the method according to the invention the active rotary feedthrough 20 is operated in opposed synchronization with respect to the drill drive 10. In this, the drive motor 32 actively generates a relative rotary motion of the two line connections 21 and 22 to each other, which has the same rotational speed but the opposite direction of rotation by comparison with the drill drive 10. Consequently, the active rotary feedthrough 20 compensates the rotation of the drill string 1 effected by the drill drive 10 so that the line connection 21 for the construction material hose 6 always points in the same direction and does not rotate even if the drill drive 10 operates the drill string 1 and therefore the second line connection 22 in a rotating manner.

In order to realize such an opposed synchronization a control 39 shown schematically in FIG. 1 is provided which is in operative connection with the rotary device 30 and, in particular, with its drive motor 32 or its gear transmission 33. Moreover, this control 39 is in signal connection with a rotation pick-up 38 that detects the rotation of the drill string 1 relative to the mast carriage 40 and therefore relative to the chassis 71. This rotation pick-up 38 provides the input value for the control 39.

In the area of the line connection 22 for the drill string 1 a further rotary feedthrough 70 can be provided that can take over remaining differences in the rotational position between drill string 1 and hose 6.

The rotary feedthrough 20 has an elbow 60 that forms a pipe bend about approximately 180°. At the end of this elbow 60 the line connection 21 for the construction material hose 6 is designed. By means of the elbow the line connection 21 for the construction material hose 6 is arranged in a downward directed manner so that the connected construction material hose 6 can run in at this point without forming any bends.

The invention claimed is:

1. A drilling apparatus for working the ground, the apparatus comprising:

a drill drive for driving a drill string in a rotating manner, a construction material hose to carry a construction material to be pumped through the drill string and into the ground, a rotary feedthrough arranged above the drill drive and on an upper side of the drill string and positioned coaxially with the drill string for passing the construction material from the construction material hose into an interior of the drill string, a first line connection connecting the construction material hose to the rotary feedthrough, a second line connection connecting to the drill string, the second line connection is further coupled to the first line connection via the rotary feedthrough, wherein the rotary feedthrough includes a rotary device adapted to actively rotate the second line connection relative to the first line connection so that a rotary motion of the drill string is compensated actively to prevent bending or winding of the construction material hose around the drill string or the drill drive, a controller configured to control the rotary device to compensate for the rotation of the drill drive such that the rotary device is synchronized diametrically opposed to the drill drive, and a rotation pick-up for determining the rotational speed and the direction of rotation of the drill string, wherein the rotation pick-up is connected with the controller.

2. The drilling apparatus according to claim 1, wherein the rotary device has at least one drive motor for actively rotating the second line connection relative to the first line connection.

3. The drilling apparatus according to claim 2, wherein the drive motor is an electric motor or a hydraulic motor.

4. The drilling apparatus according to claim 2, wherein the drive motor is arranged above the second line connection for the drill string on the rotary feedthrough.

5. The drilling apparatus according to claim 1, wherein the drill string is attachable to a tool section arranged below the drill drive and to an extension arranged above the drill drive, the rotary feedthrough is arranged on the extension, and an auger is provided on the tool section.

6. The drilling apparatus according to claim 1 further comprises:

a supporting structure in particular a mast carriage, onto which the drill drive is arranged, and a transfer connection for the construction material hose, the transfer connection is arranged on the supporting structure.

7. The drilling apparatus according to claim 1, wherein on the first line connection for the construction material hose the rotary feedthrough has an elbow and the first line connection for the construction material hose is arranged axially parallel to the second line connection for the drill string.

8. The drilling apparatus according to claim 1, wherein the construction material hose hangs down freely from the first line connection for the construction material hose.

9. The drilling apparatus according to claim 1, wherein, onto the first line connection or onto the second line connection, a further rotary feedthrough is connected, and the rotary feedthrough has a slip coupling between the two line connections.

10. The drilling apparatus according to claim 1 further comprises:

a mast, and a mast carriage slidably supported on the mast, wherein the drill drive is mounted on the slidable mast carriage.

11. The drilling apparatus according to claim 10 further comprises:

a transfer connection arranged in a rotationally fixed manner on the slidable mast carriage, wherein a lower end of the construction material hose is connected to the transfer connection.

12. A method for working the ground, in particular by means of the drilling apparatus according to claim 1, the method comprising:

setting the drill string into rotary motion by means of a drill drive and introducing a liquid construction material to the drill string via the rotary feedthrough, which is connected at the first line connection to the construction material hose and at the second line connection, wherein the second line connection is rotatable relative to the first line connection, wherein the liquid construction material is introduced at least temporarily from the construction material hose into the interior of the drill string, using the rotary device to actively rotate the second line connection relative to the first line connection, and wherein the rotary device is operated in diametrically opposed synchronization with the drill drive.

* * * * *